US008850715B2

(12) United States Patent
Swoboda et al.

(10) Patent No.: US 8,850,715 B2
(45) Date of Patent: Oct. 7, 2014

(54) PROCESS AND INSTALLATION FOR DRYING ARTICLES

(75) Inventors: Werner Swoboda, Boeblingen (DE); Andreas Keller, Simmersfeld (DE)

(73) Assignee: Eisenmann AG, Böblingen (DE)

( * ) Notice: Subject to any disclaimer, the term of this patent is extended or adjusted under 35 U.S.C. 154(b) by 2005 days.

(21) Appl. No.: 11/899,210

(22) Filed: Sep. 4, 2007

(65) Prior Publication Data

US 2008/0060217 A1 Mar. 13, 2008

(30) Foreign Application Priority Data

Sep. 7, 2006 (DE) ..... 10 2006 042 501

(51) Int. Cl.
*F26B 3/04* (2006.01)
*F26B 21/14* (2006.01)
*F26B 25/00* (2006.01)

(52) U.S. Cl.
CPC ..... *F26B 21/14* (2013.01); *F26B 2210/12* (2013.01); *F26B 25/006* (2013.01)
USPC ..... 34/381; 34/449; 34/78; 34/90; 432/230; 48/111; 198/345.3; 110/344; 110/346; 110/233; 60/783

(58) Field of Classification Search
USPC ..... 34/380, 381, 446, 443, 449, 477, 77, 34/78, 80, 90; 110/342, 344, 220, 222, 110/346, 233; 362/555; 432/144, 230; 60/446, 783; 48/99, 111; 198/80.1, 198/345.3
See application file for complete search history.

(56) References Cited

U.S. PATENT DOCUMENTS 2,346,500 A * 4/1944 Moore ..... 134/25.1
3,577,784 A * 5/1971 Kovacic ..... 374/125
3,807,396 A * 4/1974 Fischel ..... 128/201.21
3,831,294 A 8/1974 Freze
3,891,496 A * 6/1975 Erwin ..... 159/47.1

(Continued)

FOREIGN PATENT DOCUMENTS

DE 3729891 A1 * 3/1989 ..... G01N 30/12
DE 39 07 259 A1 10/1991

(Continued)

OTHER PUBLICATIONS

European Patent Office, EPO Search Report dated Feb. 15, 2008.

*Primary Examiner* — Steve M Gravini
(74) *Attorney, Agent, or Firm* — Factor Intellectual Property Law Group, Ltd.

(57) ABSTRACT

What is described is a process and an installation for drying articles, in particular painted vehicle bodies, in which the articles are moved through a drying zone in which they are hardened in an inert-gas atmosphere. Inert gas is taken from the drying zone constantly or intermittently and is first of all conducted along a first face which is at a first temperature at which higher-boiling contaminants condense out. The condensate that forms in the process is discharged. After that, the inert gas which has been pre-cleaned in this way is conducted along at least one second face which is at a lower temperature than the first face. Lower-boiling contaminants are precipitated at this point. These condensates, too, are then discharged. This process and installation work more favorably, energy-wise, and with higher cleaning efficiency than known processes and installations of a similar type.

16 Claims, 2 Drawing Sheets

(56) References Cited

U.S. PATENT DOCUMENTS

| | | | | | |
|---|---|---|---|---|---|
| 4,098,554 | A | * | 7/1978 | Huber et al. | 356/312 |
| 4,122,240 | A | * | 10/1978 | Banas et al. | 428/655 |
| 4,185,397 | A | * | 1/1980 | Hutzenlaub | 34/77 |
| 4,224,148 | A | * | 9/1980 | Lindman et al. | 210/714 |
| 4,324,052 | A | | 4/1982 | Bosher | |
| 4,396,531 | A | * | 8/1983 | Lomas | 502/22 |
| 4,545,134 | A | | 10/1985 | Mukerjee et al. | |
| 4,573,516 | A | * | 3/1986 | Quested et al. | 164/61 |
| 4,618,709 | A | * | 10/1986 | Sada et al. | 562/532 |
| 4,643,832 | A | * | 2/1987 | Iniotakis et al. | 210/712 |
| 4,735,784 | A | * | 4/1988 | Davis et al. | 588/316 |
| 4,767,527 | A | * | 8/1988 | Iniotakis et al. | 210/137 |
| 4,795,619 | A | * | 1/1989 | Lerner | 423/244.08 |
| 4,828,760 | A | * | 5/1989 | Chung et al. | 376/310 |
| 4,987,688 | A | * | 1/1991 | Petit et al. | 34/69 |
| 5,066,257 | A | * | 11/1991 | Farner et al. | 445/26 |
| 5,113,882 | A | * | 5/1992 | Gileta | 134/19 |
| 5,229,154 | A | * | 7/1993 | Street | 426/392 |
| 5,252,485 | A | * | 10/1993 | Zlobinsky et al. | 435/286.1 |
| 5,308,378 | A | * | 5/1994 | Evans et al. | 75/611 |
| 5,343,632 | A | * | 9/1994 | Dinh | 34/507 |
| 5,356,476 | A | * | 10/1994 | Foster et al. | 118/725 |
| 5,370,739 | A | * | 12/1994 | Foster et al. | 118/725 |
| 5,372,177 | A | * | 12/1994 | Foster | 164/35 |
| 5,503,811 | A | * | 4/1996 | Ahluwalia et al. | 423/2 |
| 5,556,559 | A | * | 9/1996 | Bjorkman et al. | 219/121.51 |
| 5,654,546 | A | * | 8/1997 | Lindsay | 850/9 |
| 5,770,515 | A | * | 6/1998 | Meng et al. | 438/592 |
| 6,330,820 | B1 | * | 12/2001 | Cotterill et al. | 73/9 |
| 6,391,796 | B1 | * | 5/2002 | Akiyama et al. | 438/763 |
| 2008/0041504 | A1 | * | 2/2008 | Hanrahan et al. | 148/606 |
| 2008/0115384 | A1 | * | 5/2008 | Krizek et al. | 34/510 |

FOREIGN PATENT DOCUMENTS

| | | | | | |
|---|---|---|---|---|---|
| DE | 4205793 | A1 | * | 9/1993 | G01N 1/22 |
| DE | 4439147 | A1 | * | 5/1996 | C02F 9/00 |
| DE | 10 2004 025 528 | A1 | | 2/2006 | |
| DE | 102006006661 | A1 | * | 8/2007 | F23G 7/06 |
| EP | 7325 | A1 | * | 2/1980 | C02F 1/46 |
| EP | 281680 | A1 | * | 9/1988 | G21F 9/00 |
| EP | 331842 | A1 | * | 9/1989 | E21B 21/06 |
| EP | 488012 | A2 | * | 6/1992 | A21D 4/00 |
| EP | 512943 | A1 | * | 11/1992 | B01D 5/00 |
| EP | 514841 | A1 | * | 5/1993 | H01K 9/00 |
| EP | 1041612 | A1 | * | 10/2000 | H01L 21/26 |
| EP | 1801526 | A2 | * | 6/2007 | F26B 15/12 |
| EP | 1825765 | A1 | * | 8/2007 | |
| GB | 2066098 | A | * | 7/1981 | C30B 11/00 |
| GB | 2135229 | A | * | 8/1984 | B23K 1/04 |
| JE | 2004247162 | A | * | 9/2004 | H01J 37/20 |
| JP | 54099493 | A | * | 8/1979 | G01N 17/00 |
| JP | 54149284 | A | * | 11/1979 | H01K 3/26 |
| JP | 55004937 | A | * | 1/1980 | H01L 21/302 |
| JP | 55031183 | A | * | 3/1980 | B22F 3/10 |
| JP | 55058303 | A | * | 5/1980 | B22F 9/14 |
| JP | 55058304 | A | * | 5/1980 | B22F 9/14 |
| JP | 55106538 | A | * | 8/1980 | B01J 19/00 |
| JP | 56057876 | A | * | 5/1981 | C09K 11/16 |
| JP | 57180047 | A | * | 11/1982 | H01J 27/26 |
| JP | 58034180 | A | * | 2/1983 | C23G 1/08 |
| JP | 59047084 | A | * | 3/1984 | B23K 26/12 |
| JP | 59083706 | A | * | 5/1984 | B22F 9/08 |
| JP | 59218262 | A | * | 12/1984 | B23K 1/08 |
| JP | 61059238 | A | * | 3/1986 | G01N 1/10 |
| JP | 61060839 | A | * | 3/1986 | C22B 34/12 |
| JP | 61129262 | A | * | 6/1986 | B22D 11/10 |
| JP | 62145816 | A | * | 6/1987 | H01L 21/30 |
| JP | 63032847 | A | * | 2/1988 | H01J 37/20 |
| JP | 63233093 | A | * | 9/1988 | C30B 15/34 |
| JP | 63239180 | A | * | 10/1988 | C30B 15/14 |
| JP | 63268540 | A | * | 11/1988 | B22D 11/06 |
| JP | 01014109 | A | * | 1/1989 | C01B 33/02 |
| JP | 01014110 | A | * | 1/1989 | C01B 33/02 |
| JP | 01053732 | A | * | 3/1989 | B22D 11/01 |
| JP | 01208450 | A | * | 8/1989 | C23C 14/22 |
| JP | 01310781 | A | * | 12/1989 | B09B 3/00 |
| JP | 02217142 | A | * | 8/1990 | B22D 11/06 |
| JP | 02223783 | A | * | 9/1990 | F25D 23/00 |
| JP | 02280881 | A | * | 11/1990 | B08B 3/10 |
| JP | 03032447 | A | * | 2/1991 | B22D 11/00 |
| JP | 03106562 | A | * | 5/1991 | B23K 1/008 |
| JP | 03107404 | A | * | 5/1991 | B22F 9/08 |
| JP | 04045516 | A | * | 2/1992 | H01L 21/027 |
| JP | 04293276 | A | * | 10/1992 | H01L 35/34 |
| JP | 0505218 | A | * | 3/1993 | B23K 1/008 |
| JP | 05092119 | A | * | 4/1993 | B01D 53/02 |
| JP | 05097578 | A | * | 4/1993 | C30B 25/14 |
| JP | 05131265 | A | * | 5/1993 | B22D 23/00 |
| JP | 06108119 | A | * | 4/1994 | B22F 9/08 |
| JP | 06125025 | A | * | 5/1994 | H01L 23/473 |
| JP | 06128096 | A | * | 5/1994 | C30B 29/40 |
| JP | 06170499 | A | * | 6/1994 | B22D 11/06 |
| JP | 06201677 | A | * | 7/1994 | G01N 31/00 |
| JP | 06300674 | A | * | 10/1994 | G01N 1/22 |
| JP | 07155121 | A | * | 6/1995 | A23L 1/10 |
| JP | 07258763 | A | * | 10/1995 | C22B 25/06 |
| JP | 08045698 | A | * | 2/1996 | H05H 1/26 |
| JP | 08067508 | A | * | 3/1996 | C01B 31/02 |
| JP | 08157976 | A | * | 6/1996 | C22B 9/16 |
| JP | 09049625 | A | * | 2/1997 | F23G 7/00 |
| JP | 09077599 | A | * | 3/1997 | C30B 33/02 |
| JP | 09161680 | A | * | 6/1997 | H01J 9/38 |
| JP | 10072605 | A | * | 3/1998 | B22F 9/08 |
| JP | 10072606 | A | * | 3/1998 | B22F 9/08 |
| JP | 10121115 | A | * | 5/1998 | B22F 9/08 |
| JP | 10121151 | A | * | 5/1998 | C21D 9/56 |
| JP | 10121152 | A | * | 5/1998 | C21D 9/56 |
| JP | 10172951 | A | * | 6/1998 | H01L 21/304 |
| JP | 11236265 | A | * | 8/1999 | C04B 35/52 |
| JP | 11342457 | A | * | 12/1999 | B22D 11/10 |
| JP | 2000182973 | A | * | 6/2000 | H01L 21/205 |
| JP | 2001026508 | A | * | 1/2001 | A01N 59/06 |
| JP | 2003034778 | A | * | 2/2003 | C09J 7/02 |
| JP | 2004002085 | A | * | 1/2004 | C04B 35/52 |
| JP | 2004076090 | A | * | 3/2004 | C22B 7/02 |
| JP | 2006219313 | A | * | 8/2006 | |
| JP | 2006290698 | A | * | 10/2006 | |
| JP | 2007098367 | A | * | 4/2007 | |
| JP | 2007201077 | A | * | 8/2007 | |
| JP | 2009233657 | A | * | 10/2009 | |

* cited by examiner

PROCESS AND INSTALLATION FOR DRYING ARTICLES

RELATED APPLICATIONS

This application claims priority to German Patent Application Serial No. 10 2006 042 501.4, filed Sep. 7, 2006, the content of which is incorporated herein by reference.

TECHNICAL FIELD

The invention relates to a process for drying articles, in particular painted vehicle bodies, in which a) the articles are moved through a drying zone in which they are hardened in an inert-gas atmosphere; and b) inert gas, which is conducted along at least one face which is cooled to a temperature that lies below the dew point of contaminants contained in the inert gas, is taken from the drying zone constantly or intermittently;

and said invention also relates to an installation for drying articles, in particular painted vehicle bodies, which has c) a dryer tunnel whose interior space is filled with an inert-gas atmosphere;

d) a conveying system by means of which the articles can be moved through the dryer tunnel;

e) a condensation apparatus which contains at least one component which has a surface that can be cooled to below the dew point of contaminants which have been entrained with the inert gas.

BACKGROUND OF THE INVENTION

Paints which have to be hardened in an inert-gas atmosphere, for example under UV light, in order to prevent unwanted reactions with constituents of the normal atmosphere, in particular with oxygen, have increasingly gained importance recently. These new types of paint are distinguished by very great surface hardness and very short polymerisation times. In the case of painting installations which are operated with the articles running through continuously, the last-mentioned advantage translates directly into shorter installation lengths, which naturally leads to considerably lower investment costs.

In order to reduce the consumption of inert gas and in this way save on costs, it is known, from DE 10 2004 025 528 A1, to take inert gas from the drying tunnel constantly or intermittently. This gas is then conducted along a face which is cooled down to a temperature that lies below the dew point of the lowest-boiling contaminants contained in the inert gas. In this way, substantially all the contaminants condense out on this cooled face.

This known installation and process, which work at a single condensation temperature, are not yet optimum energy-wise or as regards cleaning efficiency.

SUMMARY OF THE INVENTION

An object of the present invention is to provide a process and an installation of the type initially mentioned, in which more effective cleaning of the inert gas can be achieved while using less energy.

As far as the process is concerned, this object may be achieved through the fact that the inert gas in step b is first conducted along a first face which is at a first temperature at which higher-boiling contaminants condense out, and that the condensate that forms in the process is discharged; the inert gas which has been pre-cleaned in this way is conducted along at least one second face which is at a lower temperature than the first face, at which temperature lower-boiling contaminants are condensed out, and that the condensate that forms in the process is discharged.

According to the present invention, therefore, the condensing-out of the contaminants contained in the inert gas does not occur "in one step" at the lowest temperature which is necessary for this purpose, but in stages. First of all, the higher-boiling condensates are precipitated on a face which has not been cooled very intensively, and are removed from the inert gas. This has the advantage that the higher-boiling condensates are reliably not yet solid, that is to say can flow away easily. Furthermore, the contaminants removed in the first stage do not have to be cooled down, with the others, to the lower temperatures, a fact which has a favourable effect, energy-wise. In this way, only the lowest-boiling contaminants arrive on the most intensively cooled face, where they are likewise essentially liquid. They are not hindered from flowing away by solid contaminants which have been precipitated.

It saves energy if the faces which are not at the lowest temperature and along which the contaminated inert gas is conducted are cooled by cooled and cleaned inert gas flowing in countercurrent. In this way, the cleaned inert gas, which after all has to be brought to the temperature prevailing in the drying zone again, is supplied with energy from the contaminated inert gas which, in the process, cools down in the desired manner.

For the purpose of cooling the face which is at the lowest temperature and along which contaminated inert gas is conducted, use may be made, at least partially, of liquid gas which is taken from a storage container. For this purpose, use may also be made, instead of or in addition to the liquid gas, of gas which was vaporized shortly beforehand and which is therefore close to the vaporization temperature.

It is particularly expedient to use the inert gas itself as the liquid gas.

The articles brought into the drying zone must be freed from oxygen which has been carried along with them, by flushing with inert gas. This entails a loss of inert gas which must be replaced. In addition, dryer zones are never entirely leakproof, so that part of the inert gas, if only a small part, is also always lost as a result of this and, once again, must be replaced. This happens in the case of that form of embodiment of the process in which the gas which has been taken from the storage container for cooling purposes and heated up on the cooled faces is supplied to the drying zone directly or via an air heater.

Instead of the cryo-technique touched upon above, use may also be made, for the purpose of cooling the coolest face, of refrigerant which is taken from a conventional refrigerating machine.

The great majority of the contaminants condensed out on the cooled faces flow away in liquid form. All the same, it can happen that part of the contaminants condensed out is left sticking to the cooled faces. In this case, a variant of the process should be used, in which at least part of the cooled faces along which contaminated inert gas is conducted is cleaned from time to time mechanically, by flushing or thermally, in particular by means of hot steam.

As far the installation is concerned, the abovementioned object of the invention is achieved through the fact that the condensation apparatus has: a first component which has a surface that can be cooled down to a first temperature which lies below the dew point of higher-boiling contaminants, said first component having a first drain via which the higher-boiling contaminants can be discharged; and, at least one second component which has a surface that can be cooled down to a second temperature which lies below the dew point of lower-boiling contaminants, said second component having a second drain via which the lower-boiling contaminants can be discharged.

The advantages of the installation according to the present invention and of its further developments correspond, mutatis mutandis, to the abovementioned advantages of the process according to the invention and of its variants.

These and other objects and advantages will be made apparent from the following brief description of the drawings and the detailed description of the invention.

DETAILED DESCRIPTION OF THE PRESENT INVENTION

Figure 1:
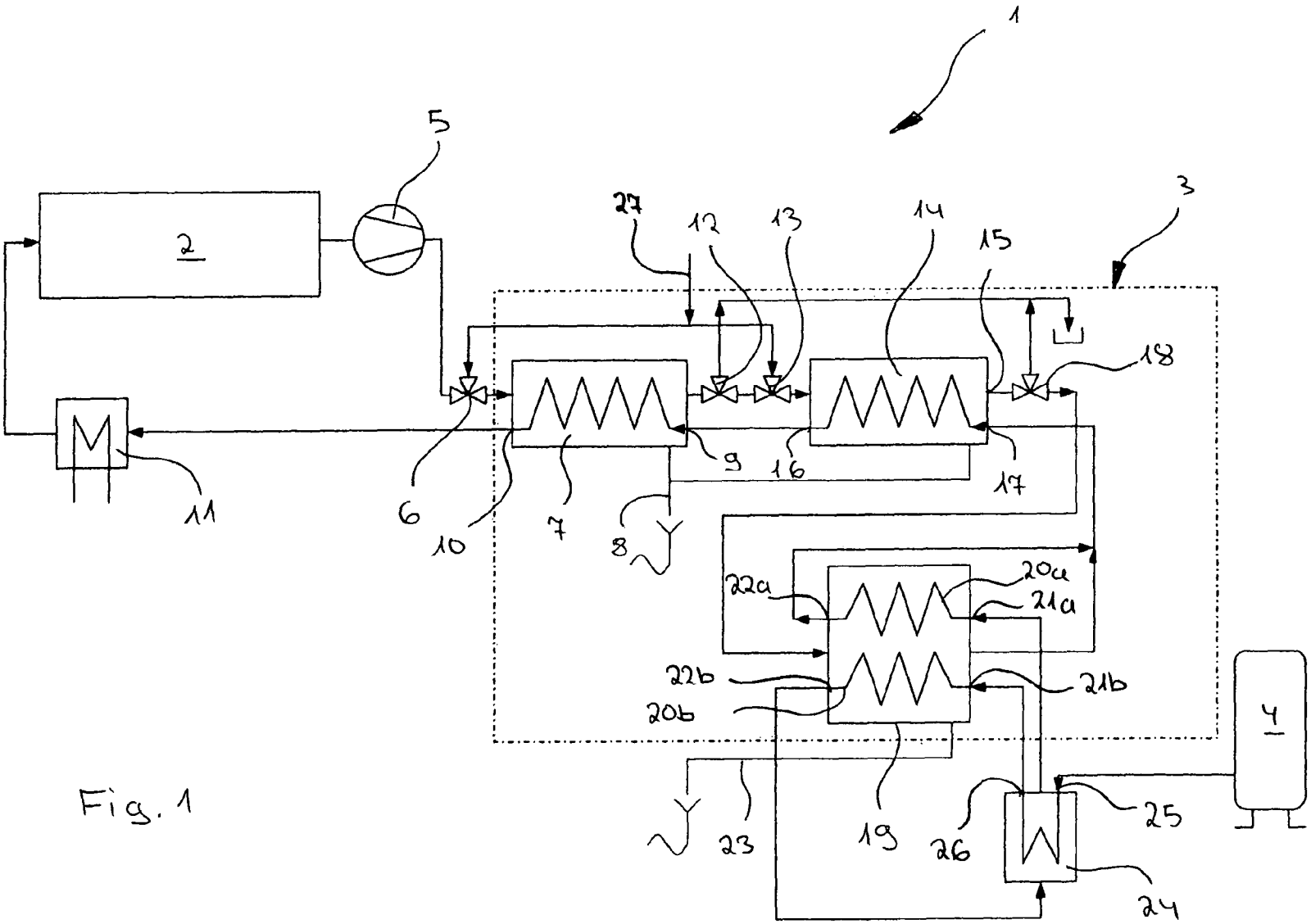
FIG. 1 shows the functional diagram of a first exemplified embodiment of an installation for drying painted vehicle bodies.

While this invention is susceptible to embodiment in many different forms, there is shown in the drawings, and will herein be described in detail, preferred embodiments of the invention while the understanding that the present disclosure is to be considered as an exemplification of the principles of the invention and is not intended to limit the broad aspect of the invention to the embodiments illustrated.

Reference will be made, first of all, to FIG. 1. This shows an installation for drying vehicle bodies which is denoted, as a whole, by the reference numeral 1 and which has three main components: the actual dryer 2 which has a drying zone, a condensation apparatus 3 and also a storage tank 4 for liquid nitrogen. These three main components are connected to one another in a manner which is described below, and are supplemented by various smaller units.

The dryer 2 possesses a known type of construction. The vehicle bodies coming out of a painting booth, which is not represented, are continuously guided, with the aid of a conveying system, through the drying zone of the dryer 2, where they are heated so that solvent is expelled or the paint is hardened in the usual, known manner. On account of the paints used, this drying operation takes place in an inert-gas atmosphere. In the exemplified embodiment which is described below and represented in FIG. 1, nitrogen is used as the inert gas; other inert gases, in particular $CO_2$ or even helium, may also be employed.

Since, in the course of operation of the dryer 2, the inert gas absorbs contaminants, in particular solvents or cracking products of the paint, it has to be cleaned constantly or intermittently. This comes about, as is described in greater detail in the above-mentioned DE 10 2004 025 528 A1, through the fact that inert gas is taken from the dryer 2 and cooled down in the condensation apparatus 3 to an extent such that, in the end, all the contaminants are condensed out, and that the cleaned inert gas is then heated again and supplied to the dryer 2.

The special feature of the installation 1 described here consists in the configuration of the condensation apparatus 3, which is surrounded by chain-dotted lines in FIG. 1. The inert gas is supplied to said apparatus from the dryer 2 with the aid of a blower 5 via a multi-way valve 6. The temperature of this insert gas is about 200° C.

The first component of the condensation apparatus 3, into which the inert gas passes, is a first heat-exchanger 7. This is configured, like the other heat-exchangers which are mentioned below, as a tube-type heat-exchanger. The inert gas coming from the dryer 2 is fed into the space surrounding the tube system.

The tube system itself has inert gas, which has already been cleaned and pre-cooled, flowing through it in countercurrent, coming from the right in FIG. 1. This inert gas cools down the contaminated inert gas washing around the tubes to an extent such that the high-boiling contaminants can condense out and be removed via a condenser drain 8. In the process, the temperature of the inert gas entering the tube system of the first heat-exchanger 7 via the inlet 9 is set, on entering said first heat-exchanger 7, to about minus 40° C. in a manner which will become clear later on. Said gas leaves the first heat-exchanger 7 via the outlet 10 at a temperature of about 50° C., and is then conducted to an air heater 11, which it leaves at a temperature of about 200° C. The cleaned inert gas is then brought back into the dryer 2 at this temperature.

The contaminated inert gas conveyed by the blower 5 has a temperature of about 110° C. on leaving the first heat-exchanger 7. As mentioned above, the higher-boiling contaminants have already been removed at this point in time. The inert gas runs through two multi-way valves 12, 13, the significance of which will likewise only become clear later on, and passes into a second heat-exchanger 14. Basically the same operations take place in the second heat-exchanger 14 as in the first heat-exchanger 7, but at lower temperatures. This means that the pre-cleaned inert gas, which is already somewhat cooler, washes around the tube system and, cooled by the latter, leaves the second heat-exchanger 14 at an outlet 15 at a temperature of about 20° C.

Cleaned inert gas, which has been pre-cooled in a manner yet to be described, enters the tube system of the second heat-exchanger 2 at the inlet 17 at a temperature of about minus 130° C. and, on flowing through the said tube system, is heated by the partially cleaned inert gas washing around the tube system to a temperature of about minus 40° C., at which it passes, as already mentioned above, into the first heat-exchanger 7 via the inlet 9 of the latter.

Part of the contaminants, which are still being entrained by the inert gas here, condenses out afresh in the second heat-exchanger 14 and is likewise supplied to the condensate drain 8.

If the route of the inert gas which has been pre-cleaned in the heat-exchangers 7 and 14 is pursued further, said gas passes from the outlet 15 of the second heat-exchanger 14 into a third heat-exchanger 19 via a further multi-way valve 18. This heat-exchanger 19, too, is a tube-type heat-exchanger; in contrast to the first two heat-exchangers 7 and 14, however, it possesses two mutually independent tube systems 20*a* and 20*b*. The tube system 20*a* has an inlet 21*a* and an outlet 22*a*, while the tube system 20*b* possesses an inlet 21*b* and an outlet 22*b*.

The largely pre-cleaned inert gas flowing in from the second heat-exchanger 14 via the multi-way valve 18, which gas possesses, as already mentioned above, a temperature of about 20° C., flows around both tube systems 20*a*, 20*b* of the third heat-exchanger 19 and is cooled down, in the process, to a temperature of about minus 140° C. This temperature is sufficient to precipitate all, or almost all, the low-boiling contaminants out of the inert gas. These condensates are supplied to a condensate drain 23 and disposed of.

The gases which flow through the two pipe systems 20*a* and 20*b* of the third heat-exchanger 19 originate from the storage container 4 which contains liquid nitrogen at a temperature of minus 196° C. This liquid nitrogen is conducted to an input 25 of a vaporizer 24. Said vaporizer 24 is likewise a tube-type heat-exchanger. The liquid nitrogen taken from the storage container 4 is vaporized in the tube system of the vaporizer 24 and leaves said vaporizer 24 via an outlet 26 at a temperature of about minus 160° C.

The gaseous nitrogen then runs through the second tube system 20*b* of the third heat-exchanger 19 from the inlet 21*b* of the latter to its outlet 22*b* and is heated, in the process, to a temperature of about 0° C. At this temperature, the nitrogen then passes into the space surrounding the tube system of the vaporizer 24, where it is cooled once again to a temperature of about minus 160° C.

At this temperature, the nitrogen then enters the tube system 20*a* of the third heat-exchanger 19 and runs through the latter from its inlet 21*a* to the outlet 22*a*. It then possesses a temperature of about 0° C. After that, it is mixed with the cleaned inert gas leaving the third heat-exchanger 19, so that the inert gas which has passed into the input 17 of the second heat-exchanger 14 and which is composed of cleaned inert gas which has been fed back, and fresh inert gas which has been taken from the storage container 4, now has a temperature of minus 130° C.

The supply of fresh nitrogen from the storage container 4 is matched, on the one hand, to the cooling performance required and, on the other, to the unavoidable loss of inert gas, particularly inside the dryer 2.

Part of the condensate does not flow away completely from the heat-exchangers 7 and 14, but is deposited on the outer walls of the tube systems. The heat-exchangers 7, 14 therefore have to be cleaned from time to time. For this purpose, solvent can be fed to the spaces surrounding the tube systems of the heat-exchangers 7 and 14 via a line 27 and the multi-way valves 6 and 13 which have already been mentioned above. When the solvent passes through the heat-exchangers 7 and 14, the condensates adhering to the tube systems are detached and flushed out. The solvent laden with the detached contaminants is disposed of via the multi-way valves 12 and 18.

The heat-exchangers 7 and 14 may also be cleaned thermally, for example by means of hot steam, instead of by flushing with solvents.

In the exemplified embodiment, which has been described above with the aid of FIG. 1, of an installation for drying painted vehicle bodies, contaminants were condensed out in three stages, that is to say in three heat-exchangers 7, 14, 19 connected in series. The cooling necessary for this purpose took place after the fashion of a cryo-condensation technique using liquid nitrogen. Instead of the nitrogen, it is also possible, as already mentioned above, to employ liquid carbon dioxide. In this case, the temperature values which arise at the inlets and outlets of the various heat-exchangers are naturally different from those indicated above in the case of liquid nitrogen.

In the exemplified embodiment, which will now be explained with the aid of FIG. 2, of a drying installation for painted vehicle bodies, cooling does not take place by means of cryo-condensation but with the aid of a multi-stage compression-type refrigerating machine; moreover, condensing-out occurs only in two stages. In other respects, however, the basic principle of the installation in FIG. 2 is identical to that in FIG. 1, so that parts which correspond can be denoted by the same reference numerals, plus 100.

Figure 2:
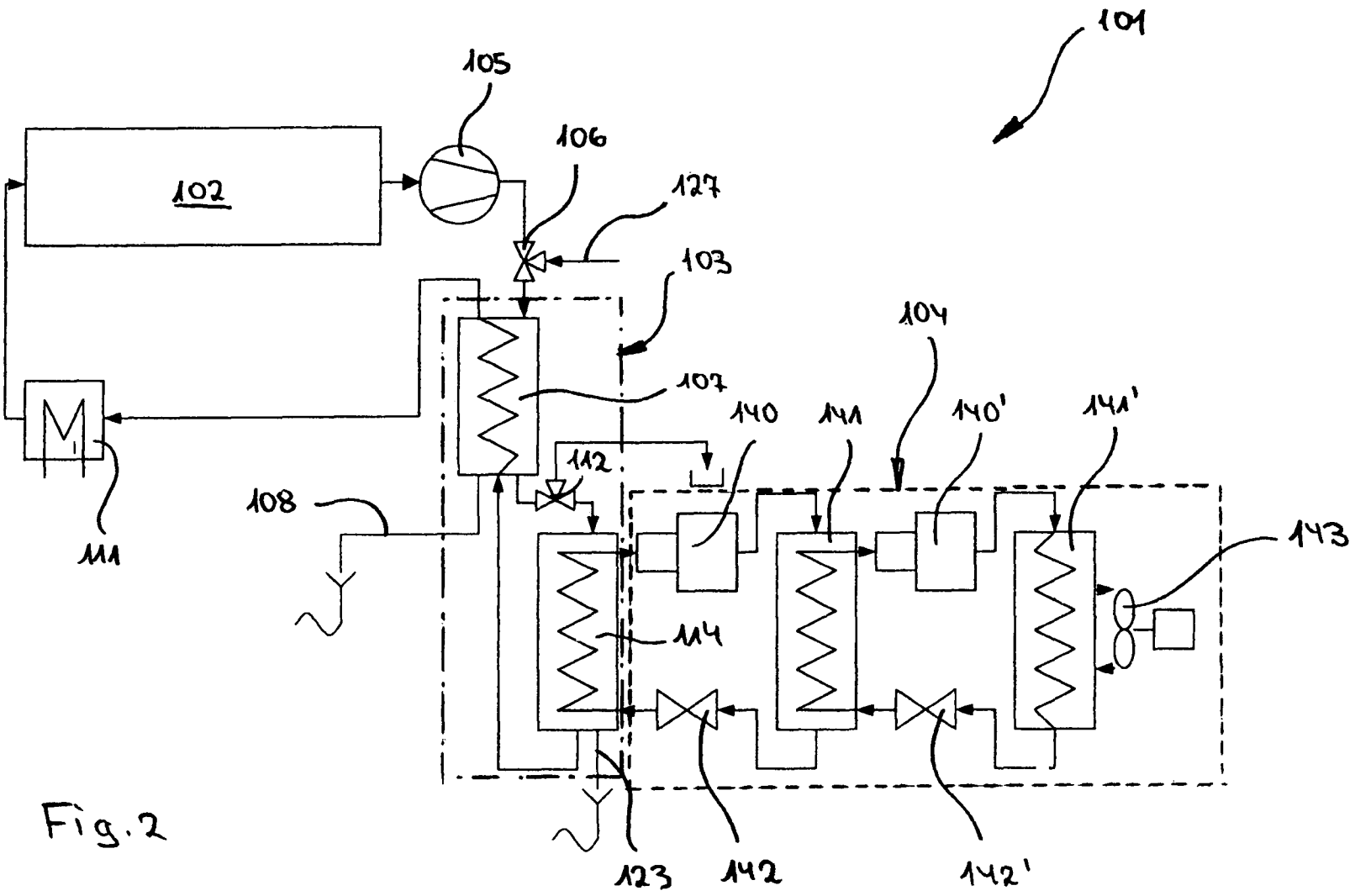
FIG. 2 shows the functional diagram of a second exemplified embodiment of an installation of this type.

In particular, the situation in the case of the installation 101 in FIG. 2 is as follows:

Once more, it is possible to make out a dryer 102, from which contaminated inert gas is taken with the aid of the blower 105, and to which cleaned inert gas at a temperature of about 200° C. is supplied via the air heater 111.

The contaminated inert gas is, once again, conducted to a condensation apparatus 103 at a temperature of 200° C. via a multi-way valve 106. It flows through the space surrounding the tube system of the first heat-exchanger 107 and leaves the latter at a temperature of about 20° C. In the process, the higher-boiling contaminants are condensed out and supplied to the condensate drain 108.

The tube system of the heat-exchanger 107 has, flowing through it in countercurrent, inert gas which arrives at a temperature of about minus 80° C. and leaves said heat-exchanger 107 at a temperature of about 100° C.

The partially cleaned inert gas leaving the first heat-exchanger 107 enters the second heat-exchanger 114 via the multi-way valve 112. It flows through the space surrounding the tube system and is cooled down, as it does so, to a temperature of about minus 80° C. In the process, the lower-boiling contaminants are condensed out and disposed of via the condensate drain 123. The inert gas which has been cleaned in this way leaves the second heat-exchanger 114 at a temperature of about minus 80° C. and passes into the tube system of the first heat-exchanger 107, where it is heated to a temperature of 100° C. at which it is conducted to the air heater 111. As already mentioned, said air heater brings the cleaned inert gas to the temperature of 200° C. prevailing in the dryer 102.

The tube system of the second heat-exchanger 114 has, flowing through it, a refrigerant which was cooled down, on entering the tube system of the second heat-exchanger 114, to a sufficiently low temperature by a source of refrigerant 104.

Said source of refrigerant 104 comprises a two-circuit cascade. Each of these cascades, in turn, possesses a compressor 140, 140', a condenser 141, 141' and a relief throttle 142, 142'. Each of the two stages of the dual cascade comprises a closed refrigerant circuit: the refrigerant circuit of the first stage leads from the compressor 140 via the condenser 141, the throttle 142 and the tube system of the second heat-exchanger 114, while the refrigerant circuit of the second stage leads from the compressor 140' through the tube system of the condenser 141', the throttle 142' and the tube system of the condenser 141 of the first stage. The condenser 141' of the second stage is cooled by a blower 143. Alternatively, water cooling is also a possibility here.

In this exemplified embodiment, only the first heat-exchanger 107, in which the higher-boiling contaminants are precipitated, is cleaned from time to time. For this purpose, solvent is introduced, via a line 127 and the multi-way valve 106, into the space surrounding the tube system of the heat-exchanger 107. This space is flushed through, during which process the condensates precipitated on the tube system detach themselves. The solvent which carries the contaminants with it in this way is transferred out and disposed of via the multi-way valve 112.

Instead of a two-circuit refrigerating machine, it is naturally also possible, if necessary, to employ a machine of this kind having more or fewer stages.

Both the exemplified embodiments which have been described above can be operated in the following manner: The inert gas is first of all concentrated without cleaning, inside the dryer 2 or 102, until a certain limit of contaminants is reached. During this time, or part of this time, the condensation apparatus 3 or 103 can be cleaned. When the limit of concentration of the contaminants which has been touched upon is reached, the inert gas is cleaned with the aid of said condensation apparatus 3 or 103.

If a continuous cleaning process is desired, the condensation apparatus 3 or 103 represented in FIGS. 1 and 2 may be provided in duplicate. Then one of the condensation apparatuses 3 or 103 is in use at any given time for cleaning the inert gas which has been taken from the dryer 2 or 102, while the other condensation apparatus 3 or 103 is being freed from precipitated condensate.

It is also true of both exemplified embodiments, that collected condensate can be used as the flushing agent for cleaning the heat-exchangers and, on the other hand, can be supplied to an aftertreatment installation, for example a thermal afterburning device, for disposal.

In the case of both the exemplified embodiments described, the contaminated inert gas flows, in each case, through the space surrounding the tube system of the various heat-exchangers 7, 14, 19, 107, 114, while the clean inert gas, which is guided through said heat-exchangers 7, 14, 19, 107, 114 in countercurrent, flows through the relevant tube system. Naturally, the inverse method of operation is also possible, in which the contaminated inert gas flows through the tube system in each case, and the cleaned inert gas flows through the space surrounding the tube system in the various heat-exchangers 7, 14, 19, 107, 114. In this case, the contaminants are precipitated on the inner superficies of the tube systems and have to be removed therefrom from time to time. Besides the possibilities, which have been touched upon above, of cleaning by flushing or thermal treatment, there also arises, at this point, the mechanical possibility in which pipe-clearing devices are sent through the tube system in order to scrape the contaminants off the walls concerned.

It is again emphasized that the above-described embodiments of the present invention, particularly, any "preferred" embodiments, are possible examples of implementations merely set forth for a clear understanding of the principles of the invention. Many variations and modifications may be made to the above-described embodiments of the invention without substantially departing from the spirit and principles of the invention. All such modifications are intended to be included herein within the spirit of the invention and the scope of protection is only limited by the accompanying claims.

What is claimed is:

1. A process for drying articles in which a) the articles are moved through a drying zone in which they are hardened in an inert-gas atmosphere; and b) inert gas, which is conducted along at least one face which is cooled down to a temperature that lies below the dew point of contaminants contained in the inert gas, is taken from the drying zone constantly or intermittently; wherein c) the inert gas in step b is first conducted along a first face which is at a first temperature at which higher-boiling contaminants condense out, and that the condensate that forms in the process is discharged; and, d) the inert gas which has been pre-cleaned in this way is conducted along at least one second face which is at a lower temperature than the first face, at which temperature lower-boiling contaminants condense out, and that the condensate that forms in the process is discharged, wherein at least part of the cooled faces along which contaminated inert gas is conducted is cleaned from time to time mechanically, by flushing or thermally.

2. The process of claim 1, wherein the faces which are not at the lowest temperature and along which the contaminated inert gas is conducted, are cooled by cooled and cleaned inert gas flowing in countercurrent.

3. The process of claim 1, wherein for the purpose of cooling the face which is at the lowest temperature and along which contaminated inert gas is conducted, use is made, at least partially, of liquid gas which is taken from a storage container.

4. The process of claim 3, wherein the face which is at the lowest temperature and along which contaminated inert gas is conducted is cooled, at least partially, by gas which is close to the vaporization temperature.

5. The process of claim 3, wherein the inert gas itself is used as the liquid gas.

6. The process of claim 5, wherein the gas which has been taken from the storage container for cooling purposes and heated up on the cooled faces is supplied to the drying zone directly or via an air heater.

7. The process of claim 1, wherein the face which is at the lowest temperature and along which contaminated inert gas is conducted is cooled by refrigerant which is taken from a conventional refrigerating machine.

8. The process of claim 1, wherein the contaminated inert gas is cleaned by a means of hot steam.

9. An installation for drying articles, the installation comprising:

a) a dryer tunnel whose interior space is filled with an inert-gas atmosphere;

b) a conveying system by means of which the articles can be moved through the dryer tunnel; and, c) a condensation apparatus which contains at least one component which has a surface that can be cooled to below the dew point of contaminants which have been entrained with the inert gas, wherein d) the condensation apparatus includes:

da) a first component which has a surface that can be cooled down to a first temperature which lies below the dew point of higher-boiling contaminants, said first component having a first drain via which the higher-boiling contaminants can be discharged; and db) at least one second component which has a surface that can be cooled down to a second temperature which lies below the dew point of lower-boiling contaminants, said second component having a second drain via which the lower-boiling contaminants can be discharged, wherein it is possible to bring up to at least one cooled face, along which contaminated inert gas is conducted, a cleaning agent which is able to detach adhering contaminants from the cooled faces and discharge them from the installation.

10. The installation of claim 9, wherein the components are heat-exchangers which are connected as a cascade, it being possible for cleaned, cooled inert gas to flow in countercurrent, for cooling purposes, through the heat-exchangers which do not work at the lowest temperature.

11. The installation of claim 10, wherein the heat-exchanger which works at the lowest temperature can have liquid gas and/or gas which is close to the vaporization temperature flowing through it.

12. The installation of claim 10, wherein the heat-exchanger which works at the lowest temperature can have refrigerant, which is made available by a refrigerating machine, flowing through it.

13. The installation of claim 9, wherein the cleaning agent is a solvent.

14. The installation of claim 9, wherein the cleaning agent is a hot medium.

15. The installation of claim 14, wherein the hot medium is hot steam.

16. The installation of claim 9, wherein the cleaning agent is a pipe-clearing device.

* * * * *